US012173571B2

(12) United States Patent
Rejepov et al.

(10) Patent No.: US 12,173,571 B2
(45) Date of Patent: Dec. 24, 2024

(54) SYSTEM AND METHOD TO MEASURE MUD LEVEL OF MUD CAP IN A WELLBORE ANNULUS

(71) Applicant: SAUDI ARABIAN OIL COMPANY, Dhahran (SA)

(72) Inventors: Dautmammet Rejepov, Abqaiq (SA); Yassar Kamal Zia, Abqaiq (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/306,667

(22) Filed: Apr. 25, 2023

(65) Prior Publication Data

US 2024/0360731 A1 Oct. 31, 2024

(51) Int. Cl.
*E21B 21/08* (2006.01)
*E21B 47/047* (2012.01)

(52) U.S. Cl.
CPC ..... *E21B 21/08* (2013.01); *E21B 47/047* (2020.05); *E21B 2200/20* (2020.05)

(58) Field of Classification Search
CPC ..... E21B 21/08; E21B 2200/20; E21B 47/047
See application file for complete search history.

(56) References Cited

U.S. PATENT DOCUMENTS 4,793,178 A * 12/1988 Ahern ..... G01S 15/88 73/152.58
5,063,776 A * 11/1991 Zanker ..... G01F 1/002 73/152.21
6,371,204 B1 * 4/2002 Singh ..... E21B 47/047 175/48
10,907,426 B2 2/2021 Zeidler
11,085,255 B2 8/2021 Fossli
2018/0163498 A1 * 6/2018 Hendel ..... E21B 33/038
2021/0301648 A1 * 9/2021 Li ..... G01F 23/30
(Continued)

FOREIGN PATENT DOCUMENTS

CA 2486673 C 9/2007
CN 103291284 B 12/2015
(Continued)

OTHER PUBLICATIONS

Li, J. et al.; "Modeling and Analysis of Unsteady Flow Behavior in Deepwater Controlled Mud-Cap Drilling", Brazilian Journal of Chemical Engineering, vol. 33, No. 1, Jan.-Mar. 2016, pp. 91-104 (14 pages).

(Continued)

*Primary Examiner* — Brad Harcourt
(74) *Attorney, Agent, or Firm* — Osha Bergman Watanabe & Burton LLP

(57) ABSTRACT

An apparatus is used on top of a column of drilling fluid in an annulus of a wellbore. The apparatus includes at least one floating device, at least one receiver, a communication interface coupled to the at least one receiver, a processor coupled to the at least one receiver and the communication interface, and a memory coupled to the processor. The memory includes instructions configured to perform a method that includes obtaining a start command to generate fluid level data, generating the fluid level data using the at least one floating device and the at least one receiver, and transmitting the fluid level data using the communication interface.

18 Claims, 7 Drawing Sheets

(56) References Cited

U.S. PATENT DOCUMENTS

| | | | | |
|---|---|---|---|---|
| 2021/0364336 | A1* | 11/2021 | Machocki | G01F 23/686 |
| 2023/0235661 | A1* | 7/2023 | Affleck | G01F 23/606<br>166/250.03 |

FOREIGN PATENT DOCUMENTS

| | | | |
|---|---|---|---|
| CN | 107605463 | B | 7/2020 |
| EP | 2281103 | B1 | 9/2018 |
| EP | 2156007 | B1 | 6/2019 |
| WO | 2014/074393 | A2 | 5/2014 |
| WO | 2016/137468 | A1 | 9/2016 |
| WO | 2020/251820 | A1 | 12/2020 |
| WO | 2021/195340 | A1 | 9/2021 |
| WO | 2021/236121 | A1 | 11/2021 |

OTHER PUBLICATIONS

Ruzhnikov, A.; "Theoretical Aspects and Practical Implementation of Study of Drilling Fluid Level in the Annulus While Drilling with Total Losses" ADIPEC, Nov. 2020 (6 pages).

* cited by examiner

SYSTEM AND METHOD TO MEASURE MUD LEVEL OF MUD CAP IN A WELLBORE ANNULUS

BACKGROUND

In drilling operations, it is normally important to keep the hydrostatic pressure of a mud column in the wellbore within a particular range for the drilled zone in order to prevent any influxes or wellbore collapse. When the drill string is in the wellbore, the mud column is formed in an annulus between the drill string and a wall of the wellbore. Hydrostatic pressure in the mud column is related to the mud level (height or depth of the mud column) and mud weight. The mud column may extend from the bottom of the wellbore to the surface, where changes in the mud level can be read. In some cases, the mud column may not extend to the surface, either because of conditions downhole or due to the drilling technique. In severe mud loss or lost circulation scenarios, where the mud pumped into the wellbore flows into the formation instead of rising up the annulus, the mud level in the annulus might drop, resulting in reduction in the hydrostatic pressure of the mud column. In cases where the mud column extending to the surface is relied on for keeping the hydrostatic pressure within a desired range, this mud loss results in a drop in mud level. The drop in mud level may also prevent reading of mud level changes at the surface and measurement of mud properties that impact safety of the drilling operation.

The drill string needs to be pulled out of the wellbore from time to time, e.g., in order to change a drill bit or make measurements downhole. This process is typically referred to as pulling the drill string out of the hole (POOH as is known in the art.) Typically, the drill string is pulled out of the wellbore a few joints of drill pipe at a time. When POOH dry, i.e., mud is not pumped into the wellbore while pulling drill pipes out of the hole, the level of the mud column can drop as the mud flows from the mud column to occupy the volume previously occupied by the removed drill pipes. Usually, after some number of drill pipes have been removed from the wellbore, mud is circulated to fill the wellbore. However, in some situations, the drop in mud level during POOH dry may be sufficient to induce influx into the wellbore. In some scenarios, such influx might be difficult to notice.

Without the ability to measure the mud level in the annulus, it might be difficult to detect well control events (influxes into the wellbore). In some cases, there might be a large delay in noticing influx into the wellbore, and such delay could have catastrophic consequences, even resulting in blowouts.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments, an apparatus for use on top of a column of drilling fluid in an annulus of a wellbore. The apparatus includes at least one floating device, at least one receiver, a communication interface coupled to the at least one receiver, a processor coupled to the at least one receiver and the communication interface, and a memory coupled to the processor. The memory includes instructions configured to perform a method that includes obtaining a start command to generate fluid level data, generating the fluid level data using the at least one floating device and the at least one receiver, and transmitting the fluid level data using the communication interface.

This disclosure presents, in accordance with one or more embodiments, a system for a drilling operation of a wellbore and a cementing operation of the wellbore. The system includes a well control system disposed on a well surface and a fluid with a fluid level in the wellbore. The system also includes a level detector coupled to the well control system. The level detector includes at least one floating device floating on a top surface of the fluid. The at least one floating device includes a capsule and a transmitter coupled to the capsule. The transmitter is configured to emit a laser light signal. A power source is located inside the capsule and in communication with the transmitter. The system has at least one receiver disposed below a drilling rig and above the wellbore. The receiver is configured to detect the laser light signal emitted by the transmitter. The receiver includes a mount fixture configured to couple the receiver below a rotary table of the drilling rig. The transmitter and the receiver are configured to generate fluid level data. A communication interface is coupled to the receiver and is configured to transmit the fluid level data to the well control system using the communication interface.

This disclosure presents, in accordance with one or more embodiments, a method that includes sending, using a level detection control system, a first start command to a level detector at a wellsite to generate first fluid level data, at a first timestamp, of a first fluid level in a wellbore. The method includes sending, by the level detection control system, a second start command to the level detector at the wellsite to generate second fluid level data, at a second timestamp, of a second fluid level in the wellbore. The first timestamp and the second timestamp are separated by a predetermined time duration. The method includes obtaining, by the level detection control system, the first fluid level data from the level detector. The method includes obtaining, by the level detection control system, the second fluid level data from the level detector. The first fluid level data and the second fluid level data are generated using a receiver and a plurality of floating devices. The first fluid level data describes a first drilling mud surface, at the first timestamp, of a drilling mud in the wellbore. The second fluid level data describes a second drilling mud surface, at the second timestamp that is different from the first timestamp, of the drilling mud.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
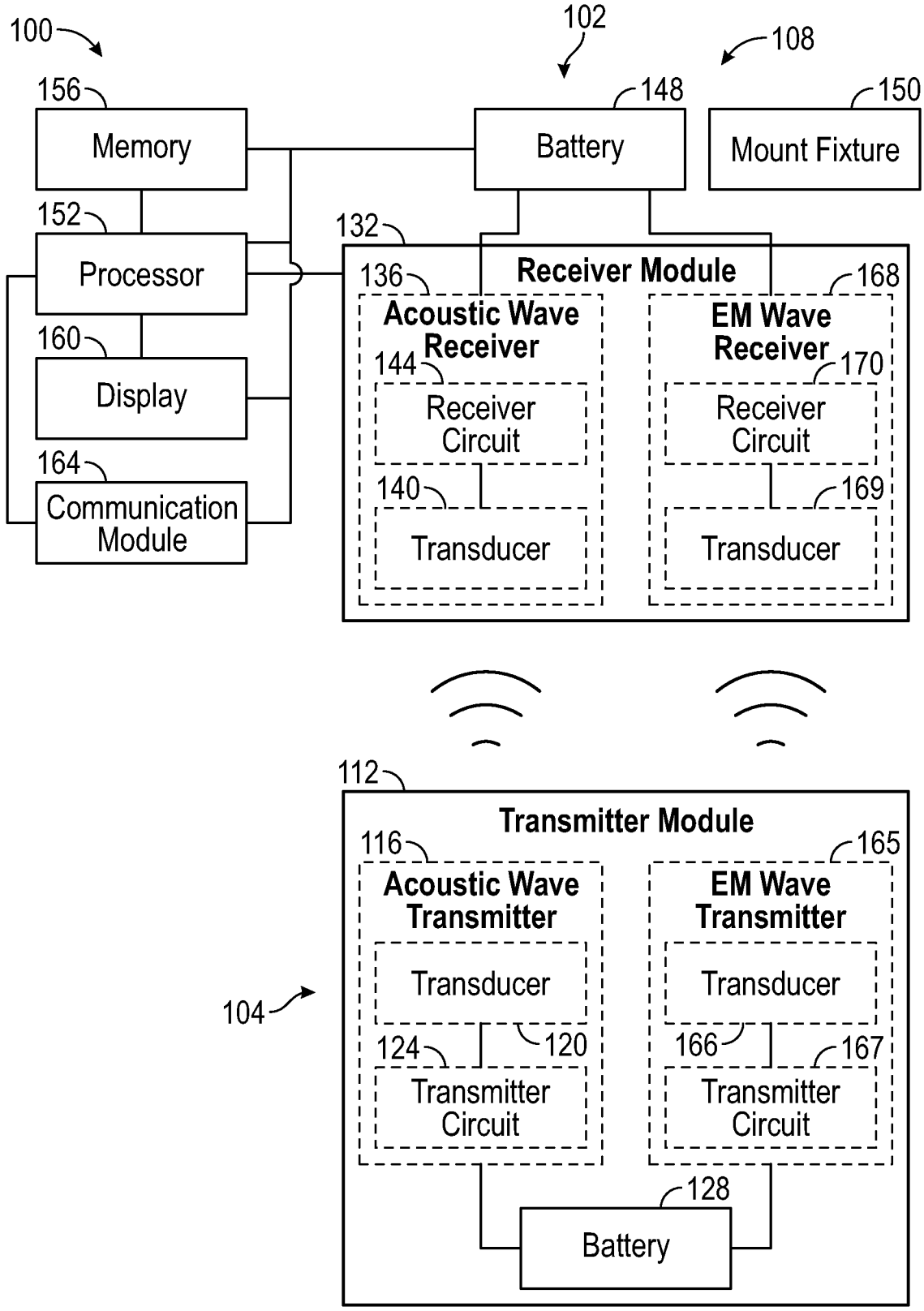
FIGS. 1, 2, 3, 4, 5, and 6 show systems in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Regarding the figures described herein, when using the term "down" the direction is toward or at the bottom of a respective figure and "up" is toward or at the top of the respective figure. "Up" and "down" are oriented relative to a local vertical direction. However, in the oil and gas industry, one or more activities take place in a vertical, substantially vertical, deviated, substantially horizontal, or horizontal well. Therefore, one or more figures may represent an activity in deviated or horizontal wellbore configuration. "Uphole" may refer to objects, units, or processes that are positioned relatively closer to the surface entry in a wellbore than another. "Downhole" may refer to objects, units, or processes that are positioned relatively farther from the surface entry in a wellbore than another. True vertical depth is the vertical distance from a point in the well at a location of interest to a reference point on the surface.

During routine drilling operations pumping mud into the well annulus is utilized in case of severe or total loss of mud (total losses) in order to maintain the hydrostatic head in annulus (for wellbore stability and well control). The mud pumped into the annulus is named a mud cap. Common industry practice is to pump a mud cap into the annulus at 2-4 BPM (barrels per minute) with 10-15 PCF (pounds per cubic foot density) higher weight than the mud use in drilling. Mud cap mud usually comprises water or lightly treated fly on mix spud mud. This practice is commonly based on field observations of the particular field. Mud cap pumping rate and the weight of the mud cap mud may be considered empirical and lacking optimization.

In general, embodiments disclosed herein describe a Mud Cap Optimization System (MCOS) to optimize mud cap pumping utilizing floating laser range finder transmitters and receivers. The transmitters would be located, for example, in the annulus and the receivers would be located, for example, below the rotary table. Use of the MCOS may provide a benefit of substantial water conservation and reduction to well construction costs.

Embodiments disclosed herein may maintain a stable dynamic mud fluid level in the annulus during total losses using the laser range finder transmitters and receivers of the MCOS. Under substantial or total loss conditions, there may be no visible returns of the drilling mud. During routine drilling practices, mud cap level is unknown. Mud cap level is not determined and relies on field past experience which might result in an unnecessarily high mud cap pumping rate and mud cap weight. Common practice does not include monitoring the dynamic fluid level in the annulus during mud cap pumping.

Obtaining and monitoring the dynamic fluid level data may provide information used advantageously to adjust the pump rate and mud cap weight. A reduction in the pump rate provides an advantage of reduced mud consumption. A major component of drilling mud may be water. A substantial environmental impact in terms of water conservation may be realized by monitoring the dynamic fluid level data. A reduction in mud cap weight provides an advantage of reduced drilling mud constituent component chemicals used to make the mud. A substantial well construction cost reduction may be realized by monitoring the mud cap weight and thereby reducing the use of mud chemicals.

A further benefit of the use of the MCOS may be realized from maintaining the stable dynamic mud fluid level in the annulus. The mud fluid level in the annulus results in a hydrostatic head in the annulus. The mud fluid level, mud weight, and therefore the hydrostatic head may be specified in the well operating parameters. Maintaining the mud fluid level may result in maintaining the specified hydrostatic head in the annulus. Maintaining the hydrostatic head in the annulus may reduce the probability of exceeding the hydrostatic head specified by the well operating parameters. Exceeding the specified hydrostatic head may result in inducing a mud loss. Induced mud loss is an undesired outcome due to the unnecessary consumption of water and chemicals for the mud.

The MCOS may provide a more accurate determination of the dynamic fluid level in the annulus, and thus may help in adjusting the flow rate and weight of mud cap accordingly to stabilize the dynamic fluid level. At a time of losses and before pumping a mud cap, the annulus fluid level is measured and the required mud cap weight (specified in the well operating parameters) is calculated and pumped into the annulus. The pump rate may then be adjusted based on the fluid column (mud cap fluid level) in annulus. If the fluid level is increasing in the annulus, the pump rate can be decreased and vice versa.

Kick detection may be improved with the continuous monitoring of the annulus level. Early signs of a kick can be inferred from the rising fluid level in the annulus. The rising level could also imply possible self-cure of the formation and decrease of loss rate. For various reasons, a rising annulus level generally triggers caution on the part of the well operation. A rising annulus level may serve as a possible early kick warning and timely measures to cope such a situation can be taken quickly.

Identification of multiple loss zones in well bore may be improved with the continuous monitoring of the annulus level. When drilling in a particular loss zone while maintaining the stable dynamic fluid level and the fluid level in the annulus suddenly starts decreasing, the decrease may be an indication of an additional loss zone in the annulus. This additional detection of subsequent loss zones will help in determining any cross flow within the aquifers and/or formations due to different regime of pressures.

Cementing operations may be improved with the continuous monitoring of the annulus level. With accurate information of all thief zones obtained during the drilling of the well, the cementing of the well can be planned accordingly. The MCOS may be used to provide the thief zone information from which a determination may be made regarding isolation of the thief zones and the degree of accuracy of the isolation of the thief zones. For example, two-stage or three-stage cementing can be considered based on information of loss zones, if accurate isolation is required, and therefor the integrity of the wellbore will be significantly enhanced with help of proper optimized cementation.

A further benefit of the use of the MCOS may be realized from the mud cap level monitoring. Instead of applying rules of thumb or previous field experience to infer adherence to the well operating parameters, an empirical approach using measured data may be facilitated by the MCOS. For example, water conservation can be optimized with implementation of the MCOS. The pump rate and the mud cap weight can be adjusted based on the monitored dynamic fluid level in the annulus. For example, if the annulus dynamic level is essentially the same with following two cases:

Case 1: 1 BPM mud cap pump rate and +5 PCF ("+5 PCF" means five pounds per cubic foot heavier mud weight for the mud pumped into the annulus in comparison with the mud weight of the mud pumped into the drillstring.)

Case 2: 4 BPM mud cap pump rate and +15 PCF ("+15 PCF" means fifteen pounds per cubic foot heavier mud weight for the mud pumped into the annulus in comparison with the mud weight of the mud pumped into drillstring)

In those two cases, the preferred case would be Case 1 because in Case 1 water conservation is maximized (less water is consumed) due to the lower BPM and chemical use for the mud cap is minimized (fewer chemicals are consumed) due to the lower PCF.

A further benefit of the use of the MCOS may be realized from the water conservation with respect to reducing the probability of an operational shutdown. For desert environments and locations with limited water supply, water conservation is critical for continuous and sustainable operations. In areas with lack of water availability, operations occasionally stop due to waiting on water supply. Furthermore, environmental aspects come into play with excessive water use in drilling operations.

The following illustrates an example operational description of MCOS. At the time of losses while drilling, multiple laser light emitting floating transmitters may be dropped in the annulus of the wellbore. The transmitters may float on the mud cap of the drilling mud in the annulus. At least one receiver will be installed below the rotary table. The laser range finder transmitters will pass laser signals heading upward to be received and detected by the pre-installed receivers. The multiple receivers and transmitters will provide the data stream for the system to generate average signals. The floating devices will be configured to ensure the laser light signals are oriented uphole, up the annulus, and toward the receivers.

The fluid level in the annulus will be determined accordingly based on those average readings of laser signals. Once the fluid level is determined, rig personnel or a computer system may calculate the required mud weight for the mud cap.

Given the required mud weight and pumping rate, rig personnel may start pumping the mud cap into the annulus. Flow rate may be adjusted based on mud column level in annulus to keep a constant level of the mud column. If the mud column level is decreasing, then the mud cap pumping flowrate can be increased and vice versa. The level detector may provide continuous feedback to the well control system to ensure the mud cap level remains within predetermined criteria such as a mud level tolerance.

FIG. 1 shows a block diagram of a system 100 and of the level detector (e.g., apparatus 102) for measuring mud level in an annulus in a wellbore according to one illustrative implementation. "Mud" or "drilling mud" is synonymous with drilling fluid, which is fluid used in operations to drill wellbores in subsurface formations. System 100 may be used while drilling and while pulling a drill string out of a wellbore.

System 100 includes a floating device 104 that is to be deployed in the annulus and a surface device 108 that is to be positioned at the surface. The receiver (surface device 108) may include a mount fixture 150. Typically, surface device 108 is positioned proximate a surface end of the annulus to allow a clear signal transmission path between transmitter(s) in floating device 104 and receiver(s) in surface device 108. In one implementation, floating device 104 includes a transmitter module 112, which is disposed in or otherwise coupled to a floatable body.

In one example, transmitter module 112 includes one or more transmitters to emit signals at prespecified frequencies. The transmitters are capable of emitting signals that travel over a long distance, e.g., over a distance of between 1 ft and 5,000 ft, or in some cases between 1 ft and 15,000 ft. In one example, transmitter module 112 includes an acoustic wave transmitter 116 that emits acoustic waves. The term "transmitter" as used here and elsewhere in the disclosure will generally encompass both a transmitter and a transmitter part of a transceiver. In general, transmitter module 112 may have one or more acoustic wave transmitters. The acoustic wave transmitter may be, for example, an ultrasonic transmitter. In one example, acoustic wave transmitter 116 includes a transducer 120, such as an ultrasonic transducer, e.g., a piezoelectric transducer or magnetostrictive transducer, and transmitter circuit 124 that is in communication with the transducer.

Transmitter circuit 124 may include a processor circuit to generate a digital signal and a digital-to-analog (DAC) circuit to convert the digital signal to an analog signal. The processor circuit may add a timestamp to the digital signal before the digital signal is converted to an analog signal. Transducer 120 converts the analog signal to an acoustic signal, which is then emitted from acoustic wave transmitter 116. Transmitter module 112 may include a battery 128 (or other portable power source) to supply power to the transmitter such as EM wave transmitter 165 and/or the acoustic wave transmitter 116.

Surface device 108 includes a receiver module 132. In one example, receiver module 132 includes one or more receivers to detect signals emitted from transmitter module 112. In one example, receiver module 132 includes an acoustic wave receiver 136 that is capable of detecting acoustic waves. The term "receiver" as used here and elsewhere in the disclosure will generally encompass both a receiver and a receiver part of a transceiver.

In general, receiver module 132 may have one or more acoustic wave receivers to detect acoustic waves. Acoustic wave receiver 136 may be, for example, an ultrasonic receiver. In one example, acoustic wave receiver 136 includes a transducer 140, such as an ultrasonic transducer, and a receiver circuit 144 that is in communication with the transducer. Transducer 140 converts an acoustic signal to an analog signal. Receiver circuit 144 may include an analog-to-digital converter (ADC) to receive the analog signal from acoustic wave receiver 136 and output a digital signal and a processor circuit to receive the digital signal and process the digital signal. For example, the processor circuit may preprocess the digital signal to remove noise and may add a time of arrival to the digital signal. Receiver module 132 may receive power from battery 148 (or other portable power source) of surface device 108 or from an external power source that is in communication with surface device 108.

To use system 100, one or more floating devices (e.g., floating device 104) are deployed into the wellbore annulus, the mud level of which is to be monitored. During a drilling operation in the wellbore or while the drill string is being pulled out of the wellbore, using the transmitter module 112, each floating device 104 will emit signals from the location of the device in the annulus. Since floating device 104 is floating on a top surface of the mud in the annulus, this location will be representative of the mud level (fluid level) in the annulus. Floating device 104 may emit signals at specific intervals, e.g., every ten seconds. As floating device 104 emits signals, surface device 108 detects the signals using receiver module 132. Receiver module 132 may output a digital signal in response to a detected signal from transmitter module 112.

Surface device 108 may include or may be coupled to a level detection control system including a processor 152 that receives the digital signal from receiver module 132 and determines a distance between the floating device (e.g., laser light output 163, FIG. 2 and FIG. 3) and a reference point at the surface, e.g., the location of receiver module 132, from the signal. The determination may be based on time information contained in the signal and a calibration curve that maps time delay between transmitter and receiver to distance. The distance will be indicative of the mud level in the annulus. Surface device 108 may include memory 156 to store the distance determined by processor 152 and other data.

Processor 152 may output the distance on a display 160 or may transmit the distance over a network via a communication interface (e.g., communication module 164.) Processor 152 may generate alerts including the distance and display or transmit the alerts, e.g., to a driller, via communication module 164. Processor 152 may routinely generate the alerts and/or generate the alerts only if the mud level falls below a prespecified level or other predetermined operational criteria from a set of predetermined operational criteria. In another example, alerts may be generated if there is a change in the rate at which the mud level is dropping. For example, processor 152 may generate an alert if the mud level is dropping constantly at a first rate and this rate then changes to a second rate that is significantly different from the first rate. An alert may also be generated if a drop in mud level stops and then the mud level starts to rise, which may indicate a wellbore kick, i.e., influx of hydrocarbons into the wellbore that can result in catastrophe if not detected.

The level detection control system may be coupled to a monitoring subsystem to monitor operational parameters such as the mud level, the mud cap level, and the rate of change of the mud level and the mud cap level. The monitoring subsystem may monitor, for example, pressure, temperature, and flowrate of the wellbore fluid and of the annular region fluid.

Transmitter module 112 may include an electromagnetic wave transmitter (e.g., EM wave transmitter 165) that emits EM waves from a laser light output 163, which may be any of laser light laser light signals, radio waves, microwaves, visible light, and infrared light. EM wave transmitter 165 may be used in addition to acoustic wave transmitter 116 or in lieu of acoustic wave transmitter 116. Transmitter module 112 may have one or more EM wave transmitters to emit EM signals. EM wave transmitter 165 may include a transmitter circuit 167 to generate a digital signal with a timestamp and a transducer 166 to convert the digital signal to an EM signal, which is then emitted from transmitter module 112.

Correspondingly, receiver module 132 may include an EM wave receiver 168 that detects EM waves. EM wave receiver 168 may include a transducer 169 to convert an EM signal to an analog signal and receiver circuit 170 to convert the analog signal to a digital signal and apply a time of arrival to the digital signal. Where transmitter module 112 includes two types of transmitters, e.g., acoustic and EM wave transmitters, the system has an opportunity to use differences in distances calculated from the two types of signals to recalibrate the measured distance between surface device 108 and floating device 104 and a reference point at the surface.

The system may be calibrated prior to deploying the floating device into the annulus or after deploying the floating device into the annulus. The difference in time between when a transmitter sends a signal and when the receiver receives the signal may be referred to as a time delay. Initially, a calibration curve that relates time delay to distance between the transmitter and the receiver is generated. For the calibration of the system, the receiver is placed at a known distance from the transmitter, and the transmitter is operated to emit a signal. The difference between the time at which the transmitter emits the signal and the time at which the emitted signal is received at the receiver gives a measured time delay at a known distance, e.g., 3' (feet) (1 m (meter)), 16' (5 m), and 66' (20 m.)

The measured time delay can be compared to the time delay obtained for the known distance from the calibration curve. This process can be repeated at other known distances. If there are significant errors between the measured time delay and the time delay from the calibration curve, the calibration curve may be adjusted such that the measured time delay corresponds to the correct distance on the adjusted calibration curve. After any adjustments, the calibration process may be repeated to confirm that the time delays determined from the system are within allowed error values. Some calibrations may require making measurements under conditions similar to downhole conditions, e.g., a long metal tube with another metal tube inside and a drilling mud type vapor in the area between the transmitter and receiver.

Figure 2:
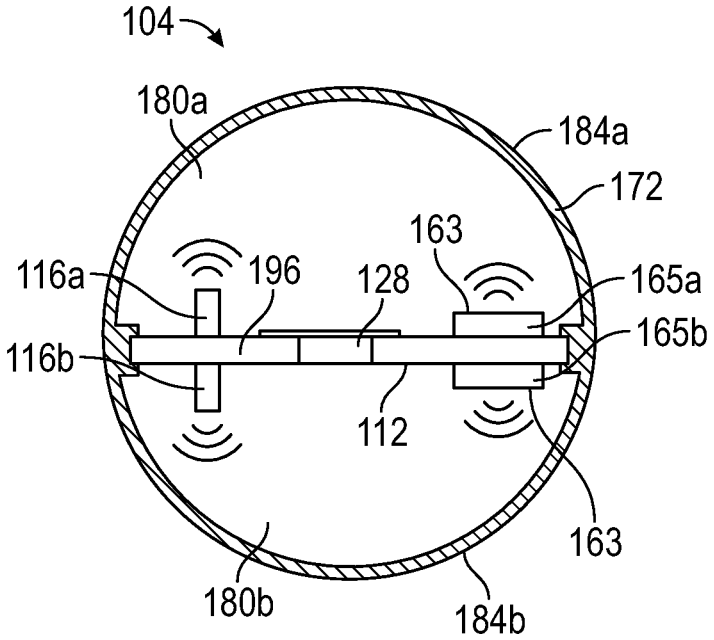

In order to allow floating device 104 to float on mud, floating device 104 may be configured to have an average density that is less than that of water, which is typically a major component of mud. FIG. 2 shows an example physical implementation of floating device 104. In FIG. 2, floating device 104 includes a capsule 172, which may be made of a lightweight material or a combination of lightweight materials.

For example, capsule 172 may have two parts that are fitted together to define an enclosed volume, and the two parts may be made of the same material or different materials. Examples of suitable materials for making capsule 172 may be thermoplastic polymers, e.g., polycarbonates, rubber materials, e.g., ethylene propylene diene monomer (EPDM) rubber, silicone rubber, neoprene rubber, Viton™, natural rubber, and synthetic rubber, plastic materials, hybrid composite materials, and materials that will have a combination of elements, e.g., a combination of rubber and, for example, plastics or fibers.

In a non-limiting example, capsule 172 may have a generally round shape, which may or may not be a spherical shape. Transmitter module 112 is disposed within capsule 172. The chambers (e.g., chamber 180*a* and chamber 180*b*) may be defined on opposite sides of transmitter module 112. Chamber 180*a* and chamber 180*b* may be filled with gas, e.g., air, nitrogen, or hydrogen, or a lightweight liquid, such as oil, to keep the average density of floating device 104 below that of water. Capsule 172 has a side 184*a* adjacent to chamber 180*a* and a side 184*b* adjacent to chamber 180*b*. In one example, chamber 180*a* and chamber 180*b* may have substantially the same volume and contain the same type of fluid such that when floating device 104 is deployed in an annulus of a wellbore, either of side 184*a* and 184*b* of capsule 172 may be the top side of floating device 104.

Continuing with reference to FIG. 2, the transmitter module 112 is provided with an acoustic wave transmitter 116*a* and an acoustic wave transmitter 116*b* of the same type as acoustic wave transmitter 116 (in FIG. 1). FIG. 2 shows the transmitter module 112 with an electromagnetic wave transmitter 165*a* and an electromagnetic wave transmitter 165*b* of the same type as EM wave transmitter 165 (in FIG. 1) with the laser light output 163. The transmitters (e.g., acoustic wave transmitter 116*a* and electromagnetic wave transmitter 165*a*) may be arranged to transmit in a direction towards side 184*a* of capsule 172, and transmitters (e.g., acoustic wave transmitter 116*b* and electromagnetic wave transmitter 165*b*) may be arranged to transmit in a direction towards side 184*b* of capsule 172. In this way, if side 184*a* is the top side of floating device 104, then acoustic wave transmitter 116*a* and electromagnetic wave transmitter 165*a* will emit the signals that are detected by the surface device. On the other hand, if side 184*b* is the top side, then acoustic wave transmitter 116*b* and electromagnetic wave transmitter 165*b* will emit the signals that are detected by the surface device.

Transmitters may be mounted on a printed circuit board (PCB) (e.g., PCB 196), which may also carry the transmitter circuits (e.g., transmitter circuit 124 and transmitter circuit 167 in FIG. 1). Battery 128 may be coupled to PCB 196. As previously noted, one type or two different types of transmitters may be included in transmitter module 112. Therefore, it is possible to omit the EM transmitters (e.g., electromagnetic wave transmitter 165*a* and electromagnetic wave transmitter 165*b* from transmitter module 112, in which case mud level will be measured by acoustic waves only. Alternatively, transmitters (e.g., acoustic wave transmitter 116*a* and acoustic wave transmitter 116*b* may be omitted such that mud level will be measured by EM waves only. When two types of transmitters are present, then it may be possible to recalibrate the measured distance between the surface and floating device 104 after the floating device has been deployed into the annulus, i.e., based on a comparison between distances measured by the two different signals.

Figure 3:
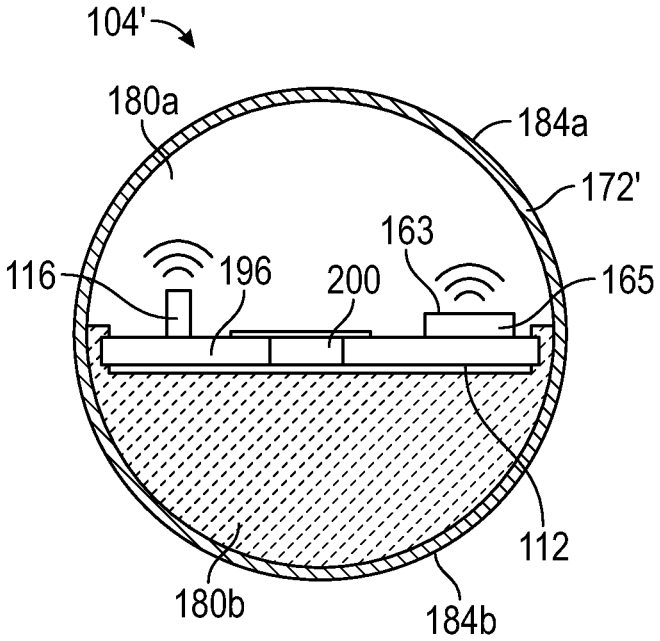

FIG. 3 shows an alternative floating device (e.g., floating device 104') that is configured to have a clear (transparent and colorless) top side and bottom side. The average density of floating device 104' is kept below that of water so that floating device 104' can still float on mud.

In the illustrated example of FIG. 3, chamber 180*b* has substantially the same volume as chamber 180*a*, but chamber 180*b* has been filled with a material that is denser than the material contained in chamber 180*a*. This makes the part of floating device 104' including chamber 180*b* to be heavier than the part of floating device 104' including chamber 180*a*. It is also possible to make the volume of chamber 180*b* greater than that of chamber 180*a* and fill chamber 180*b* with a material of greater or equal density than the material in chamber 180*a*. When floating device 104' is deployed in an annulus of a wellbore, side 184*a* of capsule 172' will be the top side of the floating device. In this case, the transmitters that emit signals in a direction towards side 184*b*, which would be the bottom side of the floating device, can be omitted. FIG. 3 shows only acoustic wave transmitter 116 and EM wave transmitter 165 that are arranged to emit signals in a direction towards the top side (e.g., side 184*a*) of capsule 172'.

Figure 4:
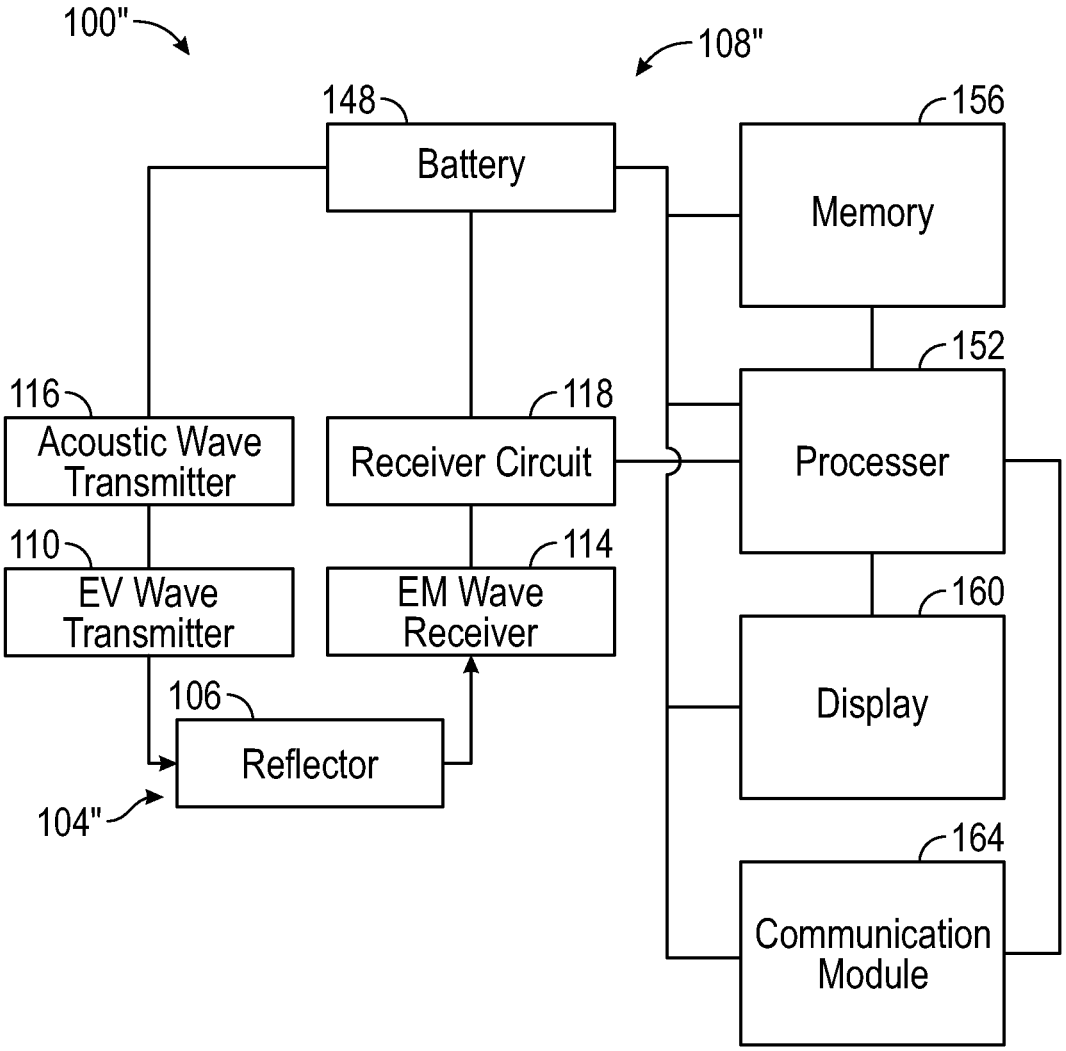

FIG. 4 shows an alternative system (e.g., system 100") of measuring mud level in an annulus in a wellbore. In system 100", surface device 108" includes an EM wave transmitter 110 to emit EM signals, and floating device 104" includes a reflector 106 to reflect the EM signals back to surface device 108". Consequently, surface device 108" also includes an EM wave receiver 114 to receive reflected EM signals from floating device 104".

In some cases, EM wave transmitter 110 and EM wave receiver 114 may be parts of an EM wave transceiver. In one implementation, EM wave transmitter 110 emits visible light signals or infrared light signals. In this case, EM wave transmitter 110 may include a light source, such as a laser source, to generate the visible light or infrared light. EM wave transmitter 110 may output single wavelength light or multiplexed wavelength light, i.e., light with different wavelengths. In this example, reflector 106 may be a highly reflective surface or a material or structure that reflects all or a narrow range of the wavelengths received from EM wave transmitter 110. As an example, reflector 106 may be a surface coated with a metallic material, such as silver. Other examples of reflectors may be diffraction grating or a dichroic filter, which may be designed to reflect only selected wavelengths while allowing others to pass through.

In this example, EM wave receiver 114 will be a photodetector that is tuned to detect the range of wavelengths reflected by reflector 106. In the system of FIG. 4, floating device 104" may not need a battery or power source. Surface device 108" may include a transmitter circuit 124 associated with EM wave transmitter 110 and a receiver circuit 118 associated with EM wave receiver 114. Processor 152 may receive data from receiver circuit 118 and process the data to determine the distance between a reference point at the surface, e.g., a position of EM wave transmitter 110 or EM wave receiver 114, and floating device 104". This distance can be correlated to the mud level in the annulus. The components including the EM wave transmitter 110, transmitter circuit 124, EM wave receiver 114, and receiver circuit 118 may be powered by battery 148 or by external power. The remaining parts of system 100" may be as described with reference to FIG. 1. System 100" may be calibrated in the same manner described for system 100 in FIG. 1.

Figure 5:
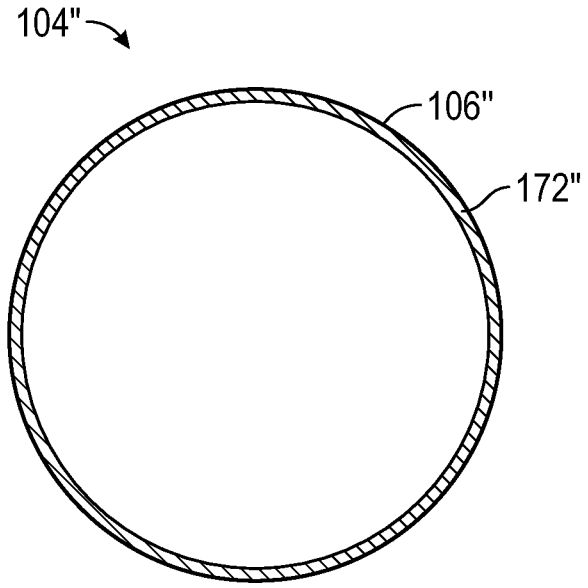

FIG. 5 shows an example physical implementation of floating device 104". In FIG. 5, floating device 104" includes a capsule 172" with an internal chamber that may be filled with a lightweight liquid, such as oil, or gas, e.g., air, nitrogen, or hydrogen, such that the average density of floating device 104" is below the density of water. Reflector 106" in this example is a highly reflective material applied on an outer surface of capsule 172", e.g., as a coating. Reflector 106" may be a metallic material, such as silver, applied as a coating on the outer surface of capsule 172" or may be a multilayer dielectric mirror coating applied on the outer surface of capsule 172". Reflector 106" may be disposed on the entire outer surface of capsule 172" or on just a portion of the outer surface of capsule 172". Where reflector 106" is disposed on just a portion of outer surface of capsule 172", buoyancy features may be incorporated in capsule 172" such that the portion of the outer surface where reflector 106" is located will be the top side of floating device 104" when the floating device 104" floats on mud. Examples of such buoyancy features has been described with reference to FIG. 3.

Figure 6:
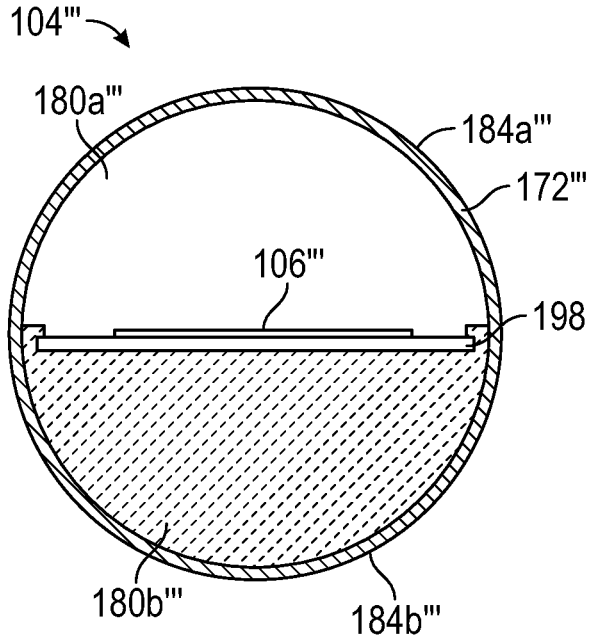

FIG. 6 shows an alternative configuration 104''' of the floating device of FIG. 5, where reflector 106''' is disposed inside capsule 172'''. In this case, floating device 104''' may be bottom-heavy so that reflector 106''' faces the top side (e.g., side 184*a*'''') of capsule 172'''. As an example, chamber 180*a*''' and chamber 180*b*''' may be formed on either side of reflector 106'''. Chamber 180*b*''' below reflector 106''' may contain a material that is heavier than the material in chamber 180*a*''' above reflector 106'''. Reflector 106''' may be a material or structure that reflects some wavelengths of light while allowing others to pass through. Examples of such reflectors may be a diffraction grating or a dichroic filter. In the example of FIG. 6, at least the top side (e.g., side 184*a*'''') will need to be transparent to light signals emitted by surface device 108" (in FIG. 4). Reflector 106''' may be supported on a substrate 198. The material of substrate 198 and the material(s) below substrate 198 (e.g., the materials in chamber 180*b*''' and the material of side 184*b*''' adjacent to chamber 180*b*''') may absorb or may be transparent to the wavelengths that pass through reflector 106'''.

Figure 7:
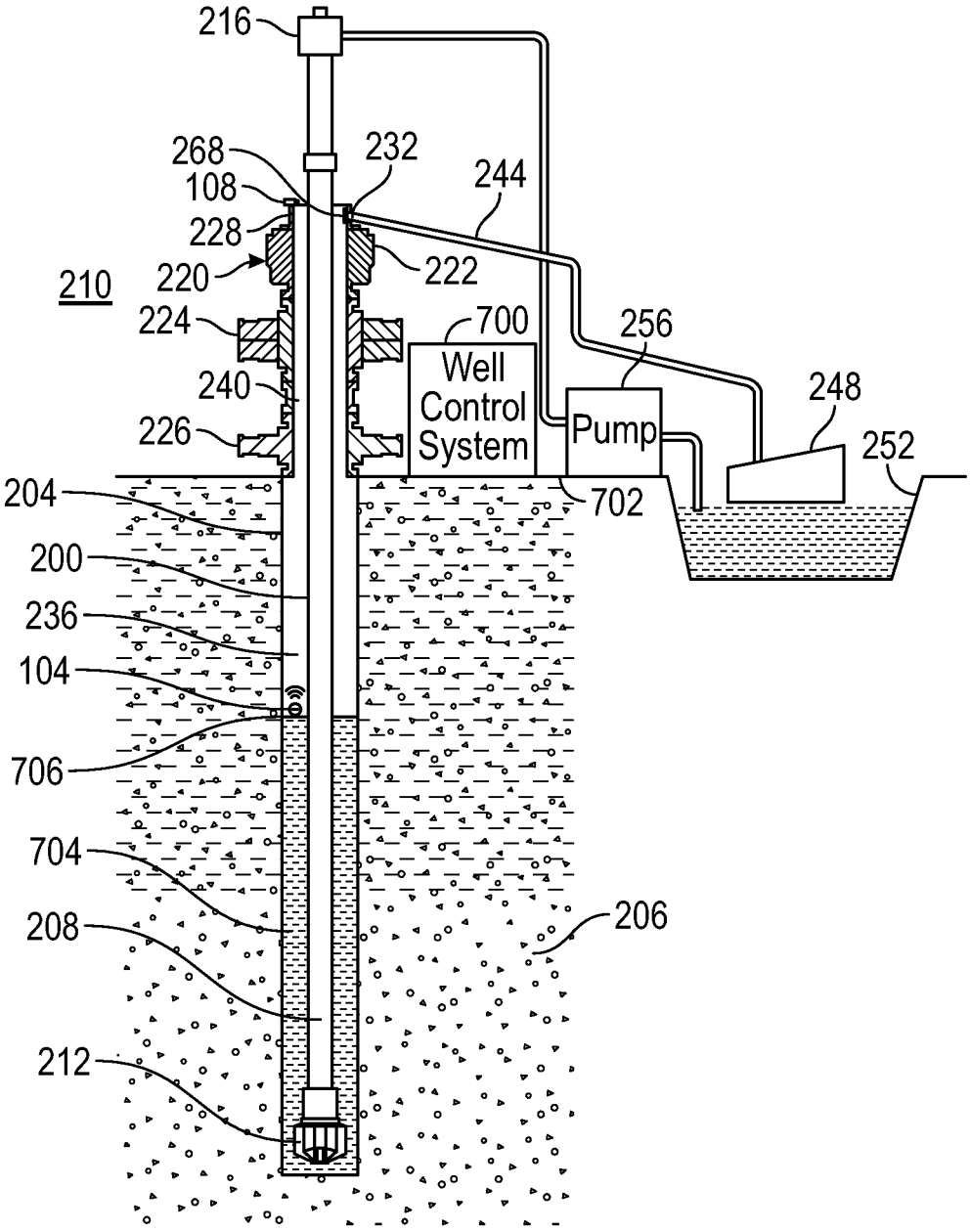
FIG. 7 is a drilling system employing a system of measuring mud level according to any one of FIGS. 1-6.

FIG. 7 illustrates an exemplary drilling environment in which the system of measuring mud level (system 100 in FIGS. 1-3 and/or system 100" in FIGS. 4-6) may be deployed. FIG. 7 shows a drilling rig above a wellbore 204 with a drill string 200 suspended in the wellbore. The wellbore is formed in a subsurface region 206. Drill string 200 includes one or more drill pipes 208 connected to form a conduit and a drill bit 212 at the end of the conduit. Drill string 200 may have several other tools not specifically identified but known in the art.

A top drive 216 is positioned in a surface region 210 above wellbore 204. A top drive 216 is coupled to the top of drill string 200 and is operable to rotate drill string. Alternatively, drill string 200 may be rotated by means of a rotary table on a rig floor. Top drive 216 is movable up and down. The mechanisms that allow top drive 216 to be movable are not shown but may generally include a traveling block that is coupled to the top drive, a derrick with a crown block that supports the traveling block, and a pulley system that moves the traveling blocking up and down the derrick, as is well known in the art.

A wellhead assembly 220 is disposed above wellbore 204. In the illustrated example, wellhead assembly 220 includes a stack of blowout preventers (an annular preventer 222, a blind ram preventer 224, and a pipe ram preventer 226 (one or more) and/or a shear ram preventer) and a bell nipple 228 attached to the top of the stack of blowout preventers—the exact configuration of the stack of blowout preventers are merely for illustrative purposes. Bell nipple 228 is a large diameter pipe with a side outlet 232.

The components of wellhead assembly 220 have bores that are aligned with wellbore 204, which allows drill string 200 to extend through wellhead assembly 220 into wellbore 204. A well annulus 236 is formed between drill string 200 and wellbore 204. In general, the wellbore may have inside it a first pipe component with a pipe external diameter smaller than a wellbore internal diameter of the wellbore thereby forming an annular space between the pipe external diameter and the wellbore internal diameter. A well system may include additional pipes deployed substantially concentrically within each other. For example, a second pipe component with a second external diameter that is smaller than the first internal diameter of the first pipe component may be installed inside the first pipe component. The difference between the first internal diameter of the first pipe component and the second external diameter of the second pipe component is another example of an annular space or annular region.

A surface annulus 240 is formed between drill string 200 and wellhead assembly 220. Surface annulus 240 is in communication with well annulus 236. As a result, fluid (e.g., a drilling mud 704) in the well annulus 236 can rise up into surface annulus 240 and exit through side outlet 232 of bell nipple 228. A flow conduit with a side outlet for exit of fluid from surface annulus 240 may be at other positions in wellhead assembly 220, such as above the pipe ram preventer 226.

For the illustration shown in FIG. 7, side outlet 232 of bell nipple 228 is connected to a flow line 244, which empties out into a shale shaker 248 (part of a mud treatment system). The fluid passing out of shale shaker 248 may be conditioned for recirculation into wellbore 204 and then fed into a mud pit 252. A pump 256 pumps mud (drilling fluid) from mud pit 252 into drill string 200. The mud may flow into drill string 200 through appropriate pathways in top drive 216 (or through a rotary swivel if a rotary table is used instead of a top drive to rotate the drill string).

During drilling, mud (e.g., the drilling mud 704) is pumped down drill string 200. The mud exits through nozzles in drill bit 212 into the bottom of wellbore 204 and then rises up well annulus 236. The hydrostatic pressure of the mud column in well annulus 236 needs to be controlled to prevent the well from kicking, either during drilling or when pulling a drill string out of the well. A well kick is forced fluid flow from a drilled formation into a wellbore due to the pressure found in the drilled formation being higher than the mud hydrostatic pressure acting on the wellbore. If the kick is not controlled, a blowout may occur.

While drill string 200 is in wellbore 204 such that well annulus 236 exists, the hydrostatic pressure that acts on the wellbore is the hydrostatic pressure of the mud column in well annulus 236. In general, hydrostatic pressure of a column of fluid is the product of the height of the column of fluid and the specific gravity of the fluid. Once a mud weight is selected, well control (control of the well) may generally involve controlling tool operations such as controlling mud circulation flowrate and mud density to maintain a certain level of mud (fluid level) in the well annulus 236. A well control system (e.g., well control system 700) may be used to control tool operations to manage the drilling operation and for control of the well. The well control system may be on the well surface (e.g., a well surface 702) and may be in communication with a level detection control system.

Floating device 104, or any variants thereof previously described, is deployed in the well annulus 236. Floating device 104 may be deployed in the well annulus 236 by simply dropping floating device 104 into well annulus 236 from the surface (e.g., well surface 702). The floating device 104 may contact the top of the drilling mud column and float on a top surface of the fluid (e.g., the top surface 706 of the drilling mud 704). The top surface 706 may be a mud cap surface of interest. The floating device may be configured for single-use. The floating device may be configured to remain in the annulus after the well drilling operation has completed and/or after the well cementing operation has been completed.

An alternative method is to pump floating device 104 down drill string 200, where floating device 104 will exit through a nozzle of drill bit 212 into the bottom of wellbore 204 and then rise up well annulus 236 to the top of the mud column in well annulus 236. In this case, floating device 104 should be sized to pass through the nozzle of drill bit 212. In some cases, the diameter of floating device 104 to enable exit through a drill bit may be about 1.5" (inch) (38 mm (millimeters)). In some cases, the hole restriction in the drill bit may be less than 1" (25 mm). In these cases, floating device 104 may be slightly larger than the hole restriction in the drill bit, but the capsule of floating device 104 may be made of flexible material, such as rubber, so that floating device 104 can be squeezed through the nozzle of drill bit 212. In this case, electronics of floating device 104 may also be on a flexible substrate.

Surface device 108, or any variants thereof, is positioned at the surface, typically close to wellbore 204 or close to a surface end of well annulus 236. In the illustrated example, surface device 108 is mounted on bell nipple 228. Surface device 108 may use mount fixture 150 to mount to bell nipple 228. Because floating device 104 may rise with the mud level into surface annulus 240 and up to the side outlet 232 of bell nipple 228, a flow line cover 268 may be mounted at side outlet 232 to prevent floating device 104 from escaping into flow line 244.

Flow line cover 268 may include a mesh material having openings smaller than floating device 104. The mesh material will allow mud to flow through while preventing floating device 104 from passing through. The openings of the meshed material can have shapes to restrict passage of floating device 104 while allowing rock debris (drilling cuttings) to go through. For example, if floating device 104 has a spherical shape, the mesh openings can have shapes that would not allow spherical shapes of a certain size to go through. Such shapes could be, for example, a long rectangular shape or a hexagonal shape. A mesh could have openings with a mix of shapes. In addition, flow line cover 268 is removable and may not be installed at side outlet 232 when drilling in conditions where the mud level will always be below side outlet 232. The mesh material may be made of a robust material such as metal or plastic.

While drilling with drill string 200 or while pulling drill string 200 out of wellbore 204, floating device 104 will emit signals in a direction that can be detected by the receiver or receivers, generally in an uphole direction, i.e., up the well annulus 236. Surface device 108 will detect the signals and determine a distance between floating device 104 and a surface reference point, e.g., a location of surface device 108, from the detected signals. This distance is indicative of the mud level in well annulus 236. Surface device 108 may display the distance and/or send alerts informing the driller of the distance. In some cases, floating device 104 may send two different types of signals up well annulus 236.

Surface device 108 will detect the two different types of signals and may determine two distances from the two different types of signals. If there are significant differences between the two distances, surface device 108 may determine which of the two distances is likely to be more accurate and recalibrate the other distance. As an example, surface device 108 may have a first calibration curve that is associated with the first type of signal and that is used to determine distance based on time information contained in the first type of signal.

Surface device 108 may also have a second calibration curve that is associated with the second type of signal and that is used to determine distance based on time information contained in the second type of signal. Recalibration may involve adjusting the first calibration curve so that it yields the same distance information as the second calibration curve, or vice versa.

In some cases, multiple floating devices (e.g., floating device 104) may be deployed into well annulus 236, each floating device emitting signals at a different frequency. The different frequencies may be selected to help with recalibration between the floating device and surface device. In some implementations, one of the multiple floating devices may emit one type of signal and another one of the multiple floating devices may emit another type of signal. Recalibration may be based on the two different types of signals in the same manner described above for a single floating device that emits two different types of signals. In certain cases using multiple floating devices, the distances may be averaged to determine an average fluid level.

In general, upon completion of drilling a well or drilling a well section, a cementing operation follows. The floating devices may be configured for remaining in the wellbore and being cemented in place.

Figure 8:
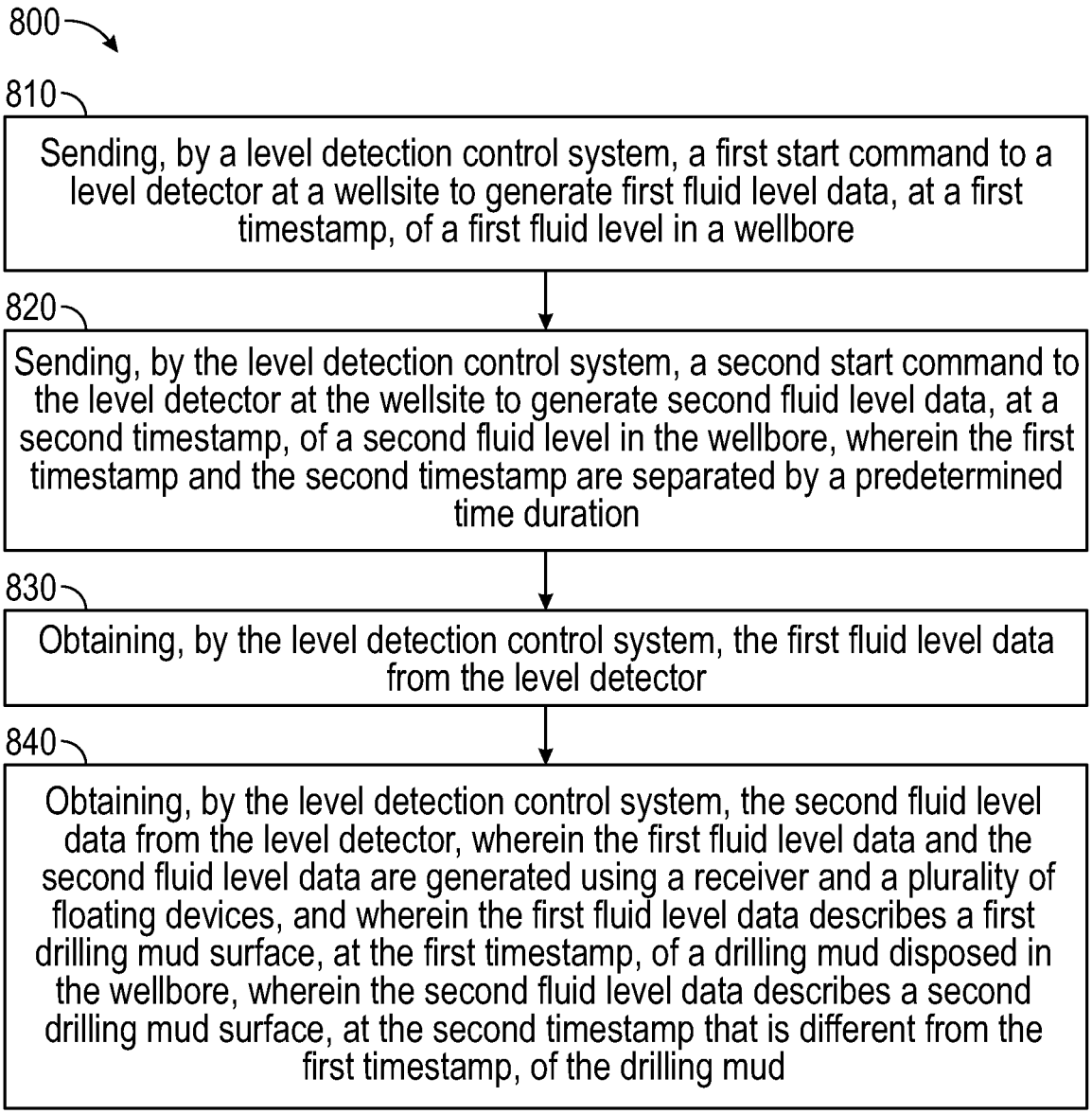
FIG. 8 is a flowchart in accordance with one or more embodiments.

FIG. 8 shows a flowchart in accordance with one or more embodiments. Specifically, FIG. 8 describes a general method using a level detector (e.g., apparatus 102) to monitor fluid level in various mud cap levels in a wellbore. One or more blocks in FIG. 8 may be performed by one or more components of the level detection system (e.g., the system 100 and/or the apparatus 102) as described in FIGS. 1-7 and 9. While the various blocks in FIG. 8 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In FIG. 8 a method (e.g., method 800) is shown for determining, monitoring, and optimizing a fluid level in an annular region of a wellbore.

At step 810, one or more commands are transmitted to one or more level detectors in a wellbore in accordance with one or more embodiments. For example, a floating device 104 may be deployed in the well annulus 236. Floating device 104 may float on top of a mud cap of a column of mud. Floating device 104 may have an EM wave transmitter 110 that emits laser light in a direction that can be received by the EM wave receiver 114. A level detection control system sends a start command such as a first start command to the level detector at the wellsite. The first start command directs the level detector to generate first fluid level data. The first fluid level data may be associated with a first timestamp related to a first fluid level in the wellbore.

At step 820, one or more commands are transmitted to one or more level detectors in a wellbore in accordance with one or more embodiments. For example, a level detection control system sends a second start command to the level detector at the wellsite. The second start command directs the level detector to generate second fluid level data. The second fluid level data may be associated with a second timestamp related to a second fluid level in the wellbore. The first timestamp and the second timestamp are separated by a predetermined time duration.

At step 830, the level detection control system obtains the first fluid level data from the level detector.

At step 840, the level detection control system obtains the second fluid level data from the level detector. The first fluid level data and the second fluid level data are generated using the EM wave receiver 168 and the plurality of floating devices (e.g., floating device 104 or floating device 104').

The first fluid level data describes a first drilling mud surface, at the first timestamp, of a drilling mud disposed in the wellbore. The second fluid level data describes a second drilling mud surface of the drilling mud, at the second timestamp that is different from the first timestamp. The first fluid level data and the second fluid level data may be used in a well simulation. A well simulation may include simulating a change in mud cap mud density and mud cap mud flowrate.

The method may include recursive feedback loops. For example, a first loop may determine a first fluid level at the first timestamp. The first loop may include transmitting the laser light, receiving the laser light, and calculating the distance of each of the laser light transmitters (e.g., EM wave transmitter 110) of the plurality of transmitters to form a set of first calculated distances. The first calculated distances will be, for example distances between the laser light output 163 and the receiver. The monitoring subsystem may monitor the operational parameters to determine a status of the monitored operational parameters such as the first calculated distances.

Average distances to represent an average fluid level are calculated to form first average distance and may be processed using an algorithm to estimate a first fluid level. This first fluid level will be associated with the first timestamp. Any of the components of the well control system, the level detector, the processor, the computer, the level detection control system, the monitoring subsystem, the receiver, or the transmitter may perform the distance calculation, the average distance calculation, and/or the fluid level determination.

The first fluid level determination may then be compared with at least one predetermined criterion such as a target fluid level. The result of the comparison may then be stored as an operational record. In addition to storing the operational record, the operational record may be reported, for example, to the driller, to the well control system and/or to a notification center. The operational record may further be reported by an alert and an advisory to the notification center and/or one or more concerned entities (e.g., a technician), as desired. The operational record may be used for performing a well simulation of the wellbore on one or more wells. The well simulation may predict a mud loss for the one or more wells. The well simulation may calculated recommended mud cap mud density and mud cap mud flowrate to meet the target fluid level.

The first loop may then repeat to determine a second fluid level at a second timestamp. The second fluid level may then be compared with predetermined operational criteria from a set of predetermined operational criteria. Furthermore, the status of the first fluid level and the status of the second fluid level may be compared and a determination may be made regarding a mud cap level rise or a mud cap level fall. This change in fluid level may then be stored, reported, and added to the operational record. The second fluid level may be used as an input for performing the well simulation.

Following the report of the change in fluid level, a decision as to further actions may be made. For example, if the change in fluid level results in a change that satisfies predetermined operational criteria from a set of predetermined operational criteria, then no action may be taken. In that case, the method may return to the start of the first loop. If the change in fluid level results in a change that fails to satisfy the predetermined criteria, then an action may be taken. The action may be to initiate a second loop.

The second loop may include sending the change in fluid level to a control system. For example, the level detection control system may send the change in fluid level to the well control system. The well simulation may be performed, for example, by the well control system using the change in fluid level to determine a fluid level change. The well simulation may predict a mud loss thereby determining a predicted mud loss for the one or more wells and may send a mud command to the well control system. The well control system may then adjust one or more drilling parameters of the drilling operation using information about the first fluid level, the second fluid level, and the predetermined time duration.

A determination may be made regarding mud cap pumping rate and mud cap density. The well control system may initiate drilling parameters change that may include a drilling mud operation to adjust the drilling mud parameters of the drilling operation. Adjusting the drilling mud parameters may include, for example, a mud parameters operation that may include a change in the mud cap parameters such as the mud cap pumping rate and the mud cap density. The change in mud cap parameters may include mixing revised mud cap mud using water and chemicals to meet a target mud cap mud density and mud cap mud pumping rate.

The well control system may then have the revised mud cap mud pumped into the wellbore and/or into the annulus. The monitoring subsystem may then continue to monitor the mud cap level by continuing the first loop. Monitoring the mud cap level may provide a status of the monitored operational parameters.

Figure 9:
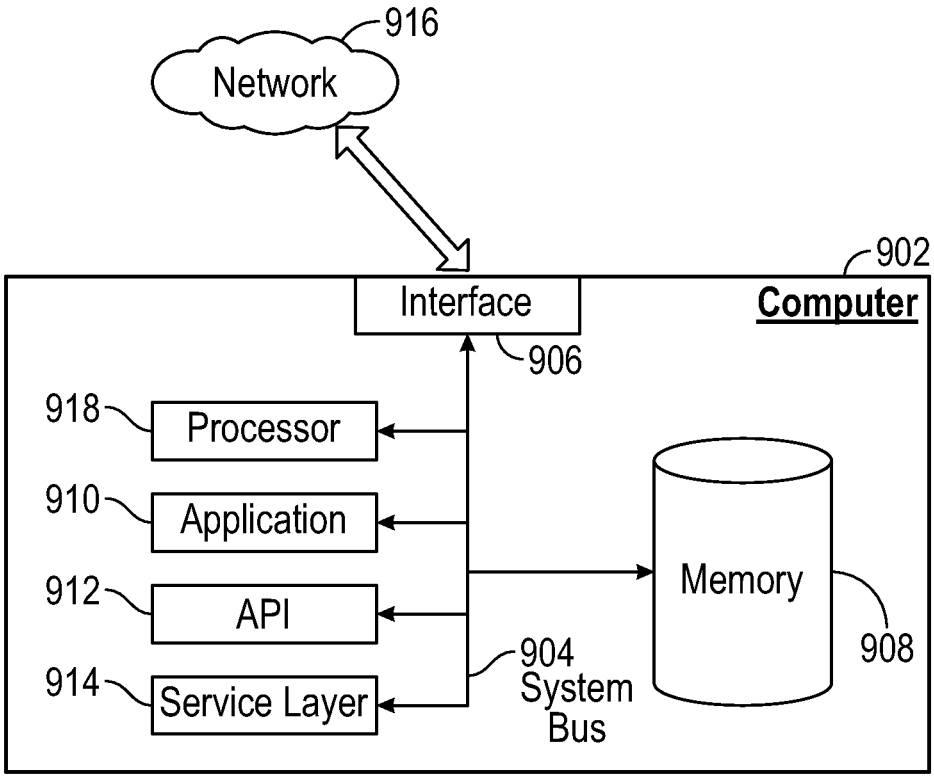
FIG. 9 is a computer in accordance with one or more embodiments.

Embodiments may be implemented on a computer system. FIG. 9 is a block diagram of a computer system. The computer shown in FIG. 9 is an example of a computer (902) used to provide computational functionalities associated with described algorithms, methods, functions, processes, flows, and procedures as described in the instant disclosure, according to an implementation. The illustrated computer (computer (902)) is intended to encompass any computing device such as a high performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (902) may include a computer that includes an input device, such as a keypad, keyboard, touch screen, or other device that can accept user information, and an output device that conveys information associated with the operation of the computer (902), including digital data, visual, or audio information (or a combination of information), or a graphical user interface.

The computer (902) can serve in a role as a client, network component, a server, a database or other persistency, or any other component (or a combination of roles) of a computer system for performing the subject matter described in the instant disclosure. The illustrated computer (computer (902)) is communicably coupled with a network (916). In some implementations, one or more components of the computer (902) may be configured to operate within environments, including cloud-computing-based, local, global, or other environment (or a combination of environments).

At a high level, the computer (902) is an electronic computing device operable to receive, transmit, process, store, or manage data and information associated with the described subject matter. According to some implementations, the computer (902) may also include or be communicably coupled with an application server, e-mail server, web server, caching server, streaming data server, business intelligence server, or other server (or a combination of servers).

The computer (902) can receive requests over network (916) from a client application (for example, executing on another computer (902)) and responding to the received requests by processing the said requests in an appropriate software application. In addition, requests may also be sent to the computer (902) from internal users (for example, from a command console or by other appropriate access method), external or third-parties, other automated applications, as well as any other appropriate entities, individuals, systems, or computers.

Each of the components of the computer (902) can communicate using a system bus (904). In some implementations, any or all of the components of the computer (902), both hardware or software (or a combination of hardware and software), may interface with each other or an interface (906) (or a combination of both) over the system bus (904) using an application programming interface (an API (912)) or a service layer (914) (or a combination of the API (912) and service layer (914). The API (912) may include specifications for routines, data structures, and object classes. The API (912) may be either computer-language independent or dependent and refer to a complete interface, a single function, or even a set of APIs. The service layer (914) provides software services to the computer (902) or other components (whether or not illustrated) that are communicably coupled to the computer (902).

The functionality of the computer (902) may be accessible for all service consumers using this service layer. Software services, such as those provided by the service layer (914), provide reusable, defined business functionalities through a defined interface. For example, the interface may be software written in JAVA, C++, or other suitable language providing data in extensible markup language (XML) format or other suitable format. While illustrated as an integrated component of the computer (902), alternative implementations may illustrate the API (912) or the service layer (914) as stand-alone components in relation to other components of the computer (902) or other components (whether or not illustrated) that are communicably coupled to the computer (902). Moreover, any or all parts of the API (912) or the service layer (914) may be implemented as child or sub-modules of another software module, enterprise application, or hardware module without departing from the scope of this disclosure.

The computer (902) includes an interface (906). Although illustrated as a single one of interface (906) in FIG. 9, two or more of the interface (906) may be used according to particular needs, desires, or particular implementations of the computer (902). The interface (906) is used by the computer (902) for communicating with other systems in a distributed environment that are connected to the network (916). Generally, the interface (906) includes logic encoded in software or hardware (or a combination of software and hardware) and operable to communicate with the network (916). More specifically, the interface (906) may include software supporting one or more communication protocols associated with communications such that the network (916) or the hardware of the interface is operable to communicate physical signals within and outside of the illustrated computer (computer (902)).

The computer (902) includes at least one of a computer processor (918). Although illustrated as a single one of the computer processor (918) in FIG. 7, two or more processors may be used according to particular needs, desires, or particular implementations of the computer (902). Generally, the computer processor (918) executes instructions and manipulates data to perform the operations of the computer (902) and any algorithms, methods, functions, processes, flows, and procedures as described in the instant disclosure.

The computer (902) also includes a memory (908) that holds data for the computer (902) or other components (or a combination of both) that can be connected to the network (916). For example, memory (908) can be a database storing data consistent with this disclosure. Although illustrated as a single one of memory (908) in FIG. 7, two or more memories may be used according to particular needs, desires, or particular implementations of the computer (902) and the described functionality. While memory (908) is illustrated as an integral component of the computer (902), in alternative implementations, memory (908) can be external to the computer (902).

The application (910) is an algorithmic software engine providing functionality according to particular needs, desires, or particular implementations of the computer (902), particularly with respect to functionality described in this disclosure. For example, application (910) can serve as one or more components, modules, applications, etc. Further, although illustrated as a single one of application (910), the application (910) may be implemented as a multiple quantity of application (910) on the computer (902). In addition, although illustrated as integral to the computer (902), in alternative implementations, the application (910) can be external to the computer (902).

There may be any number of computers such as the computer (902) associated with, or external to, a computer system containing computer (902), each computer (902) communicating over network (916). Further, the term "client," "user," and other appropriate terminology may be used interchangeably as appropriate without departing from the scope of this disclosure. Moreover, this disclosure contemplates that many users may use one of computer (902), or that one user may use multiple computers such as computer (902).

In some embodiments, the computer (902) is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, a cloud computing system may operate according to one or more service models, such as infrastructure as a service (IaaS), platform as a service (PaaS), software as a service (SaaS), mobile "backend" as a service (MBaaS), serverless computing, artificial intelligence (AI) as a service (AIaaS), and/or function as a service (FaaS).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

The detailed description along with the summary and abstract are not intended to be exhaustive or to limit the embodiments to the precise forms described. Although specific embodiments, implementations, and examples are described herein for illustrative purposes, various equivalent modifications can be made without departing from the spirit and scope of the disclosure, as will be recognized by those skilled in the relevant art. The teachings provided herein can be applied to other drilling environments, not necessarily the exemplary drilling environment generally described above.

What is claimed is:

1. An apparatus for use on top of a column of drilling fluid in an annulus of a wellbore, the apparatus comprising:

at least one floating device;

at least one receiver;

a communication interface coupled to the at least one receiver;

a processor coupled to the at least one receiver and the communication interface;

a memory coupled to the processor, wherein the memory comprises instructions configured to perform a method comprising:

obtaining a start command to generate fluid level data, generating the fluid level data using the at least one floating device and the at least one receiver, and transmitting the fluid level data using the communication interface;

a plurality of floating devices wherein the plurality of floating devices and the at least one receiver are configured to determine an average fluid level using the fluid level data from the plurality of floating devices;

wherein the at least one receiver is configured to transmit, using the communication interface, the average fluid level to a control system for controlling tool operations within the wellbore;

wherein the method further comprises recording the fluid level data after the apparatus receives the start command; and wherein the method further comprises generating the average fluid level;

wherein the method further comprises transmitting, using the communication interface, the average fluid level to the control system.

2. The apparatus of claim 1, wherein the at least one floating device comprises:

a capsule, a transmitter emitting a laser light signal, wherein the transmitter is coupled to the capsule, and a power source disposed inside the capsule and in communication with the transmitter, and wherein the at least one receiver is configured to detect a distance between the transmitter and the at least one receiver traveled by the laser light signal emitted by the transmitter;

wherein the at least one floating device is configured to direct the laser light signal in a direction detectable by the at least one receiver.

3. The apparatus of claim 1, wherein the communication interface is configured to transmit the fluid level data regarding a mud cap surface of interest to a control system for controlling tool operations within the wellbore.

4. The apparatus of claim 1, wherein the memory is configured to store the fluid level data.

5. The apparatus of claim 1, wherein the at least one floating device is configured for single-use.

6. A system for a drilling operation of a wellbore and a cementing operation of the wellbore, comprising:

a well control system disposed on a well surface;

a fluid disposed in the wellbore comprising a fluid level;

a level detector coupled to the well control system, the level detector comprising:

at least one floating device disposed on a top surface of the fluid, the at least one floating device comprising:

a capsule, a transmitter coupled to the capsule, wherein the transmitter is configured to emit a laser light signal, and a power source disposed inside the capsule and in communication with the transmitter;

at least one receiver disposed below a drilling rig and above the wellbore;

wherein the at least one receiver is configured to detect the laser light signal emitted by the transmitter, and wherein the at least one receiver comprises a mount fixture configured to couple the at least one receiver below a rotary table of the drilling rig, wherein the transmitter and the at least one receiver are configured to generate fluid level data; and a communication interface coupled to the at least one receiver;

wherein the at least one receiver is configured to transmit the fluid level data to the well control system using the communication interface;

a plurality of floating devices wherein the plurality of floating devices and the at least one receiver are configured to determine an average fluid level using the fluid level data from the plurality of floating devices;

wherein the at least one receiver is configured to transmit, using the communication interface, the average fluid level to a control system;

wherein the wellbore comprises a first pipe component with a first internal diameter and a second pipe component with a second external diameter;

wherein the second external diameter is configured to be disposed inside the first internal diameter forming an annular region between the first pipe component and the second pipe component;

wherein the first pipe component is a drill string and the second pipe component is a casing;

wherein the fluid is drilling fluid; and wherein the fluid is disposed in the annular region;

wherein the plurality of floating devices are disposed on the top surface.

7. The system of claim 6, wherein the level detector further comprises:

a processor coupled to the at least one receiver and the communication interface; and a memory coupled to the processor, wherein the memory is configured to store the fluid level data until the fluid level data is transmitted to the well control system.

8. The system of claim 6, wherein the level detector further comprises a level detection control system coupled to the communication interface.

9. The system of claim 8, wherein the level detection control system comprises a monitoring subsystem to monitor the fluid level;

wherein the level detection control system is configured to determine a status of monitored operational parameters, compare the status with a set of predetermined operational criteria, and to send a mud command, in response to determining that the monitored operational parameters fail to meet the set of predetermined operational criteria, to the well control system.

10. The system of claim 6, wherein the level detector is configured to:

obtain a start command to generate the fluid level data; and generate, in response to obtaining the start command, the fluid level data using the at least one floating device and the at least one receiver.

11. The system of claim 6, wherein the top surface of the fluid comprises a mud cap surface of interest.

12. The system of claim 6:

wherein the at least one floating device is configured to remain in the wellbore after the drilling operation and/or after the cementing operation.

13. A method comprising:

sending, by a level detection control system, a first start command to a level detector at a wellsite to generate first fluid level data, at a first timestamp, of a first fluid level in a wellbore;

sending, by the level detection control system, a second start command to the level detector at the wellsite to generate second fluid level data, at a second timestamp, of a second fluid level in the wellbore, wherein the first timestamp and the second timestamp are separated by a predetermined time duration;

obtaining, by the level detection control system, the first fluid level data from the level detector;

obtaining, by the level detection control system, the second fluid level data from the level detector;

wherein the first fluid level data and the second fluid level data are generated using a receiver and a plurality of floating devices, and wherein the first fluid level data describes a first drilling mud surface, at the first timestamp, of a drilling mud disposed in the wellbore, wherein the second fluid level data describes a second drilling mud surface, at the second timestamp that is different from the first timestamp, of the drilling mud.

14. The method of claim 13, further comprising:

performing a well simulation of the wellbore on one or more wells for a fluid level using the first fluid level data, the second fluid level data, a status of monitored operational parameters, and a set of predetermined operational criteria; and determining a predicted mud loss for the one or more wells using the well simulation.

15. The method of claim 14, further comprising:

determining the status of the monitored operational parameters, comparing the status with the set of predetermined operational criteria, and sending a mud command, in response to determining that the monitored operational parameters fail to meet the set of predetermined operational criteria, to a well control system.

16. The method of claim 15, wherein the well control system adjusts one or more drilling parameters of a drilling operation at the wellbore based on the first fluid level, the second fluid level, and the predetermined time duration.

17. The method of claim 13, further comprising:

performing a mud parameters operation based on a well simulation, using the first fluid level data, a mud density, and a mud flowrate.

18. The method of claim 13, further comprising:

providing the level detector comprising the level detection control system, the receiver, and the plurality of floating devices, in proximity to the wellbore at the wellsite;

disposing the plurality of floating devices on a top surface of a fluid level of the drilling mud in an annular region of the wellbore during a drilling operation wherein the plurality of floating devices are configured to emit a laser light signal out of a laser light output;

installing the receiver below a rotary table of a drilling rig at the wellsite, using a mount fixture (150) configured to couple the receiver below the rotary table, wherein the receiver is disposed for detecting the laser light signal;

performing a first drilling mud operation comprising:

emitting, in response to obtaining the first start command, the laser light signal from the plurality of floating devices at the first timestamp;

detecting the laser light signal by the receiver;

calculating first calculated distances between the laser light output and the receiver;

generating a first average distance of the first calculated distances;

determining the first fluid level of the first average distance; and recording the first fluid level;

performing a second drilling mud operation comprising:

emitting, in response to obtaining the second start command, the laser light signal from the plurality of floating devices at the second timestamp;

detecting the laser light signal by the receiver;

calculating second calculated distances between the laser light output and the receiver;

generating a second average distance of the second calculated distances;

determining the second fluid level of the second average distance; and recording the second fluid level;

comparing the first fluid level with the second fluid level and determining a first fluid level change;

sending a first mud command from the level detection control system to a well control system in a first response to determining the first fluid level change;

adjusting one or more drilling mud parameters of the drilling operation based on the first fluid level change;

repeating the first drilling mud operation, the second drilling mud operation, and the comparing to determine a second fluid level change;

sending a second mud command from the level detection control system to the well control system in a second response to determining the second fluid level change; and adjusting the one or more drilling mud parameters of the drilling operation based on the second fluid level change.

* * * * *